US009170516B2

(12) United States Patent
Shukuya et al.

(10) Patent No.: US 9,170,516 B2
(45) Date of Patent: Oct. 27, 2015

(54) IMAGE FORMING APPARATUS AND IMAGE FORMING METHOD

(71) Applicants: Yuichiro Shukuya, Kanagawa (JP); Katsuhiko Maeda, Kanagawa (JP)

(72) Inventors: Yuichiro Shukuya, Kanagawa (JP); Katsuhiko Maeda, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 71 days.

(21) Appl. No.: 14/020,091

(22) Filed: Sep. 6, 2013

(65) Prior Publication Data

US 2014/0072317 A1 Mar. 13, 2014

(30) Foreign Application Priority Data

Sep. 10, 2012 (JP) ..... 2012-198818

(51) Int. Cl.

*G03G 15/00* (2006.01)
*G03G 13/01* (2006.01)
*G03G 15/01* (2006.01)

(52) U.S. Cl.

CPC ..... *G03G 13/01* (2013.01); *G03G 15/0105* (2013.01); *G03G 15/5058* (2013.01); *G03G 2215/0129* (2013.01); *G03G 2215/0161* (2013.01)

(58) Field of Classification Search

CPC ..... G03G 13/01; G03G 15/0105
USPC ..... 399/49, 72
See application file for complete search history.

(56) References Cited

U.S. PATENT DOCUMENTS

| | | | | |
|---|---|---|---|---|
| 6,137,518 | A | 10/2000 | Maeda | |
| 6,249,304 | B1 | 6/2001 | Sawayama et al. | |
| 6,292,206 | B1 | 9/2001 | Takehara et al. | |
| 8,913,932 | B2 | 12/2014 | Akamatsu | |
| 2005/0200689 | A1 | 9/2005 | Shinohara et al. | |
| 2006/0002724 | A1* | 1/2006 | Fujimori et al. | 399/27 |
| 2007/0122210 | A1 | 5/2007 | Sato et al. | |
| 2007/0140721 | A1 | 6/2007 | Shinohara et al. | |
| 2007/0217831 | A1 | 9/2007 | Maeda | |
| 2008/0084571 | A1 | 4/2008 | Maeda | |
| 2008/0273902 | A1 | 11/2008 | Maeda | |
| 2010/0008681 | A1* | 1/2010 | Nagatsuka | 399/43 |
| 2011/0026082 | A1 | 2/2011 | Miyadera et al. | |
| 2011/0043588 | A1 | 2/2011 | Shukuya | |

(Continued)

FOREIGN PATENT DOCUMENTS

| | | |
|---|---|---|
| JP | 2011-048350 | 3/2011 |
| JP | 2011-112704 | 6/2011 |
| JP | 2014-59490 A | 4/2014 |

*Primary Examiner* — Rochelle-Ann J Blackman
(74) *Attorney, Agent, or Firm* — Oblon, McClelland, Maier & Neustadt, L.L.P.

(57) ABSTRACT

An image forming apparatus includes: an image forming unit that forms a pattern image for image quality adjustment on an image carrier; a detection unit that detects the pattern image for the image quality adjustment; an image quality adjustment control unit that controls an image quality adjustment process in accordance with a result of detection of the detection unit; a reception unit that receives a color mode selected from among a plurality of kinds of color modes; and a calculation unit that calculates a total pattern length so that a total length of the pattern image for the image quality adjustment in a sub-scanning direction is equal in any of the color modes, wherein the image forming unit forms the pattern image for the image quality adjustment so that the total length of the pattern image for the image quality adjustment is equal to the calculated total pattern length.

9 Claims, 7 Drawing Sheets

(56) References Cited

U.S. PATENT DOCUMENTS

| | | | | |
|---|---|---|---|---|
| 2011/0123235 | A1 | 5/2011 | Matsuzaki | |
| 2011/0205324 | A1 | 8/2011 | Shukuya | |
| 2012/0008154 | A1 * | 1/2012 | Abe | 358/1.9 |
| 2013/0107286 | A1 | 5/2013 | Shukuya | |

* cited by examiner

FIVE-COLOR MODE

FOUR-COLOR MODE (1)

FOUR-COLOR MODE (2)

FOUR-COLOR MODE

IMAGE FORMING APPARATUS AND IMAGE FORMING METHOD

CROSS-REFERENCE TO RELATED APPLICATIONS

The present application claims priority to and incorporates by reference the entire contents of Japanese Patent Application No. 2012-198818 filed in Japan on Sep. 10, 2012.

BACKGROUND OF THE INVENTION

1. Field of the Invention

The present invention relates to an image forming apparatus and an image forming method.

2. Description of the Related Art

As an electrophotography image forming apparatus, a tandem type image forming apparatus having a plurality of photosensitive elements for forming images with different colors from each other has become popular. In this tandem type image forming apparatus, an electrostatic latent image is formed by optical writing on a photosensitive element and a toner image formed by developing this electrostatic latent image is transferred to a printing medium or an intermediate transfer body. This transfer operation is performed for each color, and the toner images of the colors are overlapped on the printing medium or the intermediate transfer body, thereby providing a full-color toner image. In the case of having transferred the toner image to the intermediate transfer body, the toner image is further transferred from the intermediate transfer body to the printing medium. The toner image transferred to the printing medium is fixed on the printing medium, thereby providing the color image.

The positional deviation among the color transfer positions in such an image forming apparatus leads to the deterioration in image quality of the printing image because the color toner images are not overlapped with each other correctly. Therefore, it is necessary to correct the positional deviation among the color transfer positions.

As a method of correcting the positional deviation among the color transfer positions (hereinafter referred to as the positional deviation for short) in the electrophotography image forming apparatus, a method is known in which a positional deviation correction pattern is formed on an intermediate transfer body, a carriage belt for conveying a printing medium, or the like and the positional deviation correction is performed based on the positional information obtained by detecting the position of the positional deviation correction pattern with a sensor.

Japanese Laid-open Patent Publication No. 2011-112704 discloses an image forming apparatus including toner of two special colors in addition to general toner of four colors. In this image forming apparatus, the positional deviation correction pattern to be formed varies depending on the number of colors.

If a pattern image is formed based on one color mode out of mode performing color match control with only four colors and mode performing color match control with five or more colors, a pattern image is formed in the other color mode based on the formed pattern image. As a result, since the number of toner is different, the total pattern length varies. In that case, even though the positional deviation correction is performed based on the patter image formed according to one color mode, the total pattern length is different in the other color mode, in which case the positional deviation correction cannot be performed as appropriate.

Therefore, it is desirable to provide an image forming apparatus capable of performing positional deviation correction as appropriate on any of a plurality of color modes.

SUMMARY OF THE INVENTION

It is an object of the present invention to at least partially solve the problems in the conventional technology.

According to an aspect of the present invention, there is provided an image forming apparatus including: an image forming unit that forms a pattern image for image quality adjustment on an image carrier; a detection unit that detects the pattern image for the image quality adjustment; an image quality adjustment control unit that controls an image quality adjustment process in accordance with a result of detection of the detection unit; a reception unit that receives a color mode selected from among a plurality of kinds of color modes whose number of colors used for forming an image is different; and a calculation unit that calculates a total pattern length so that a total length of the pattern image for the image quality adjustment in a sub-scanning direction is equal in any of the color modes, wherein the image forming unit forms the pattern image for the image quality adjustment so that the total length of the pattern image for the image quality adjustment is equal to the calculated total pattern length.

According to another aspect of the present invention, there is provided an image forming method including: forming, by an image forming unit, a pattern image for image quality adjustment on an image carrier; detecting, by a detection unit, the pattern image for the image quality adjustment; controlling, by an image quality adjustment control unit, an image quality adjustment process in accordance with a result of detection of the detection unit; receiving, by a reception unit, a color mode selected from among a plurality of kinds of color modes whose number of colors used for forming an image is different; and calculating, by a calculation unit, a total pattern length so that a total length of the pattern image for the image quality adjustment in a sub-scanning direction is equal in any of the color modes, wherein the forming the pattern image includes forming the pattern image for the image quality adjustment so that the total length of the pattern image for the image quality adjustment is equal to the calculated total pattern length.

According to still another aspect of the present invention, there is provided an apparatus including: image forming means for forming a pattern image for image quality adjustment on an image carrier; detection means for detecting the pattern image for the image quality adjustment; image quality adjustment control means for controlling an image quality adjustment process in accordance with a result of detection of the detection means; reception means for receiving a color mode selected from among a plurality of kinds of color modes whose number of colors used for forming an image is different; and calculation means for calculating a total pattern length so that a total length of the pattern image for the image quality adjustment in a sub-scanning direction is equal in any of the color modes, wherein the image forming means form the pattern image for the image quality adjustment so that the total length of the pattern image for the image quality adjustment is equal to the calculated total pattern length.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 1:
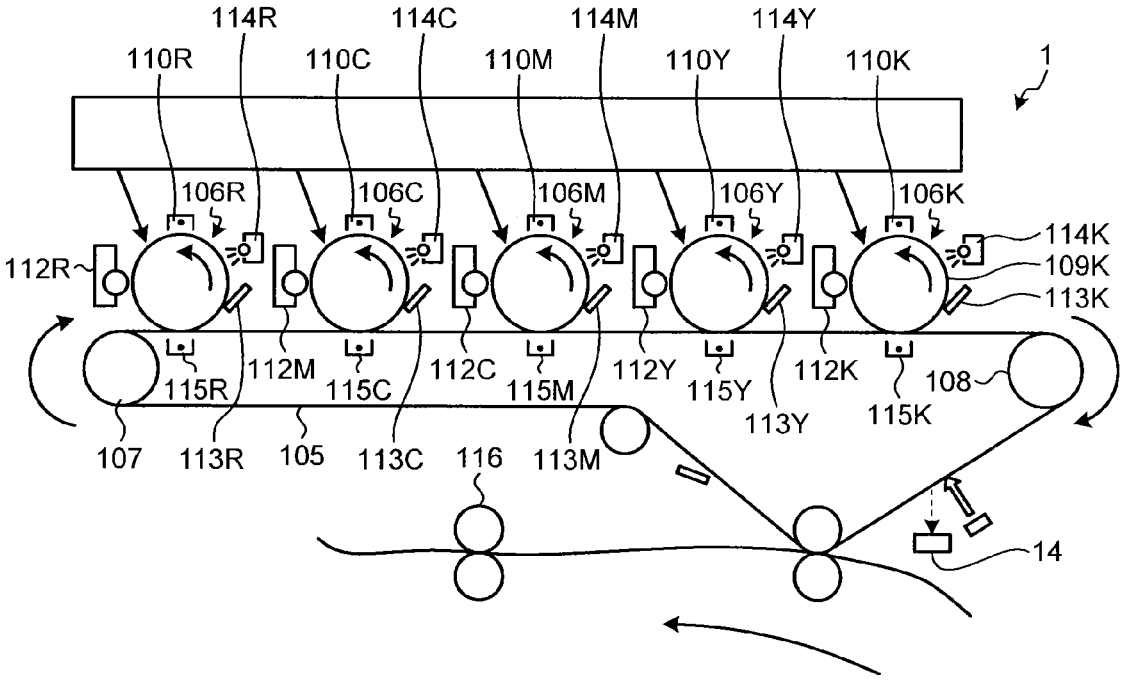
FIG. 1 is a diagram depicting an image forming apparatus of a first embodiment.

FIG. 1 mainly depicts a part performing image formation in one example of an image forming apparatus according to a first embodiment. An image forming apparatus 1 depicted in FIG. 1 is of so-called tandem type having a structure in which image forming units 106C, 106M, 106Y, 106K, and 106R for forming images of C (Cyan), M (Magenta), Y (Yellow), K (Black), and special color R (Red) are arranged along a carriage belt 105. This first embodiment describes an example of a direct transfer type image forming apparatus for directly transferring an image to a printing medium from a photosensitive drum which has been subjected to exposure in accordance with image data.

In this image forming apparatus 1, the image forming units 106K, 106Y, 106M, 106C, and 106R are arranged in this order from the upstream side of the conveying direction of this carriage belt 105 along the carriage belt 105 for conveying paper (printing medium). These image forming units 106K, 106Y, 106M, 106C, and 106R have a common internal structure except that the colors of the formed toner images are different.

In other words, for example, the image forming unit 106K includes a photosensitive drum 109K, a charger 110K, a developing unit 112K, a neutralizer 113K, and a LEDA (light-emitting diode array) head 114K, and has a transferring unit 115K at a position opposite to the carriage belt 105 relative to the photosensitive drum 109K.

Similarly, the image forming units 106Y, 106M, 106C, and 106R include a photosensitive drum 109Y, a photosensitive drum 109M, a photosensitive drum 109C, and a photosensitive drum 109R, a charger 110Y, a charger 110M, a charger 110C, and a charger 110R, a developing unit 112Y, a developing unit 112M, a developing unit 112C, and a developing unit 112R, a neutralizer 113Y, a neutralizer 113M, a neutralizer 113C, and a neutralizer 113R, and a LEDA head 114Y, a LEDA head 114M, a LEDA head 114C, and a LEDA head 114R, respectively. Moreover, the image forming units 106Y, 106M, 106C, and 106R include transferring units 115Y, 115M, 115C, and 115R at positions opposite to the carriage belt 105 relative to the photosensitive drum 109Y, the photosensitive drum 109M, the photosensitive drum 109C, and the photosensitive drum 109R, respectively.

The description is hereinafter made basically of the image forming unit 106K representing the image forming units 106K, 106Y, 106M, 106C, and 106R for avoiding complication.

The carriage belt 105 is an endless belt wound around a driving roller 107, which is driven to rotate, and a driven roller 108. This driving roller 107 is driven to rotate by a driving motor, which is not illustrated. This driving motor, the driving roller 107, and the driven roller 108 serve as a driving unit for moving the carriage belt 105.

For forming an image, the paper housed in a paper feeding tray is fed in order from the uppermost sheet by a paper feeding roller, and after the end of paper is sensed by a registration sensor for paper alignment, the paper is fed into a separation roller. Upon the reach of the paper at the carriage belt 105 after being sent out from the separation roller, the paper is suck on the carriage belt 105 due to an electrostatic suction operation, and the paper is conveyed to the first image forming unit 106K by the carriage belt 105, which is driven to rotate, where the black toner image is transferred.

The image forming unit 106K includes the photosensitive drum 109K as a photosensitive element, the charger 110K disposed around the photosensitive drum 109K, the LEDA head 114K, the developing unit 112K, a photosensitive cleaner (not illustrated), and the neutralizer 113K. The LEDA head 114 is configured, for example, with a number of laser diodes arranged so that the photosensitive drum 109K is irradiated with a laser beam linearly in a main-scanning direction.

For forming an image, the outer peripheral surface of the photosensitive drum 109K is uniformly charged by the charger 110K in darkness and then irradiated with irradiation light in accordance with image data from the LEDA head 114K, thereby forming an electrostatic latent image. The developing unit 112K visualizes this electrostatic latent image with black toner. Thus, the black toner image is formed on the photosensitive drum 109K.

Here, the photosensitive drum 109K is exposed to light for one line with one lighting of the LEDA head 114K, thereby performing one scanning in the main-scanning direction. The exposure of lines at equal intervals is performed by rotating the photosensitive drum 109K at predetermined angular velocity and turning on the LEDA head 114K in a predetermined period.

The toner image formed on the photosensitive drum 109K is transferred onto paper on the carriage belt 105 by the operation of the transferring unit 115K at a position (transfer position) where the photosensitive drum 109K is in contact with the paper. Through this transfer, the black toner image is formed on the paper.

The photosensitive drum 109K on which the toner image has been transferred is neutralized by the neutralizer 113K after the unnecessary toner remaining on the outer peripheral surface is removed with the photosensitive cleaner; then, the photosensitive drum 109K stands-by for the next image formation.

Thus, the paper on which the black toner image has been transferred in the image forming unit 106K is transferred to the next image forming unit 106Y by the carriage belt 105. In the image forming unit 106Y, a yellow toner image is formed on the photosensitive drum 109Y through a similar process to the image forming process in the image forming unit 106K, and this toner image is overlapped on and transferred to the black image formed on the paper. The paper is sequentially conveyed to the next image forming units 106M, 106C, and 106R, and through the similar process, a magenta toner image formed on the photosensitive drum 109M, a cyan toner image formed on the photosensitive drum 109C, and a red toner image formed on the photosensitive drum 109R are sequentially overlapped on and transferred to the paper. Thus, a full-color image is formed on the paper.

The paper having the full-color image formed thereon is separated from the carriage belt 105 and fed into a fixing unit 116. The fixing unit 116 includes a fixing roller and a pressing roller in contact with the fixing roller, and is configured so that the pressing roller applies a predetermined amount of pressure to the fixing roller. The fixing roller is controlled to be heated at certain temperature by a heater, which is not illustrated. At least one of the fixing roller and the pressing roller is driven to rotate at angular velocity corresponding to the conveying velocity of the carriage belt 105.

The paper is heated and pressed when the paper passes between a fixing roller 123*a* and a pressing roller 123*b*. By this heating and pressing, the toner images of the respective colors on the paper are fixed on the paper. The paper discharged from the fixing unit 116 is discharged after an end of the paper is sensed by a discharging sensor which senses the presence of paper utilizing the light reflection, for example.

Note that the image forming apparatus 1 according to the first embodiment forms the positional deviation correction pattern relative to the carriage belt 105 for correcting the positional deviation of the image to be formed. A sensor unit 14 for detecting the positional deviation correction pattern provided for the carriage belt 105 is provided on the downstream side of the driving direction of the carriage belt 105 of the photosensitive drums 109C, 109M, 109Y, 109K, and 109R.

The sensor unit 14 is disposed in a predetermined direction, and is disposed, for example, in a manner of being aligned in a direction orthogonal to the driving direction of the carriage belt 105.

Figure 2:
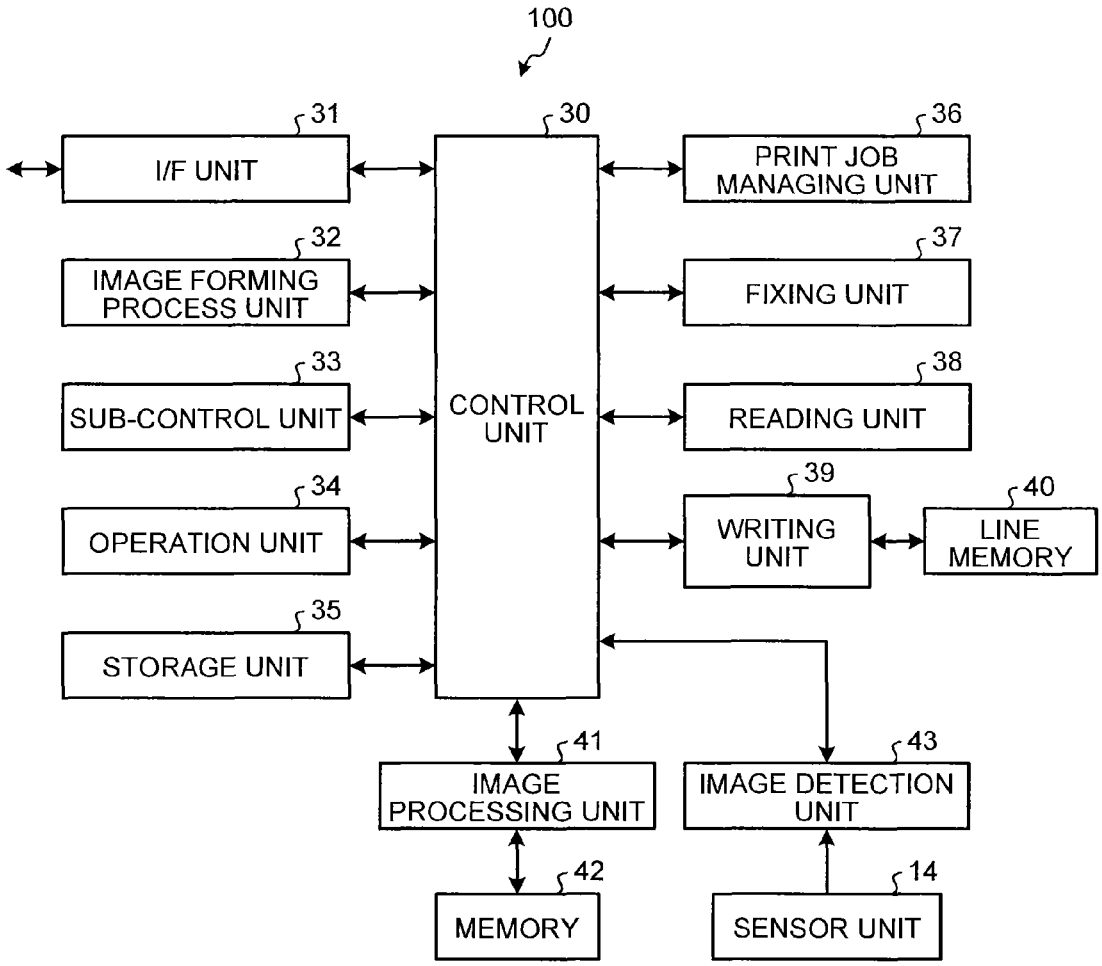
FIG. 2 is a block diagram depicting a functional structure of the first embodiment.

FIG. 2 is a function block diagram depicting one example of a configuration for controlling the image forming apparatus 1 according to the first embodiment. The image forming apparatus 1 includes a control unit 30, an I/F (interface) unit 31, an image forming process unit 32, a sub-control unit 33, an operation unit 34, a storage unit 35, a print job managing unit 36, a fixing unit 37, a reading unit 38, a writing unit 39, an image processing unit 41, and image detection unit 43.

The control unit 30 includes, for example, a CPU (Central Processing Unit), ROM (Read Only Memory), and RAM (Random Access Memory), and controls the entire image forming apparatus using the RAM as work memory in accordance a program stored in the ROM. The control unit 30 has an arbitration unit for arbitrating the data transfer on a bus, and controls the data transfer among the aforementioned units.

The I/F unit 31 is connected to an external device such as a personal computer, and controls the communication with the external device in accordance with the order of the control unit 30. For example, upon the reception of a print request or the like transmitted from an external device, the I/F unit 31 sends the request to the control unit 30. The print job managing unit 36 manages the order of printing on the print request (print job) requested to the image forming apparatus.

The image processing unit 41 is connected to a memory 42, and for example, the image data sent from the sub-control unit 33 are stored in the memory 42 once, and the image data stored in the memory 42 are subjected to predetermined image processing. The image data on which the image processing has been performed are stored in the memory 42 again. The image processing unit 41 can generate predetermined image data in accordance with the order of the control unit 30.

The sub-control unit 33 includes a CPU, for example, and controls each unit depicted in FIG. 1 in accordance with the print request, and moreover sends the image data for printing, which has been transmitted from the external device via the I/F unit 31, to the image processing unit 41. The sub-control unit 33 receives the image data after the image processing or the generated image data from the image processing unit 41 and sends the data to the writing unit 39, which is described later.

The writing unit 39 receives the image data from the sub-control unit 33, and controls the writing, i.e., exposure in accordance with the image data relative to the photosensitive drums 109C, 109M, 109Y, 109K, and 109R with the LEDA heads 114C, 114M, 114Y, 114K, and 114R in the image forming units 106C, 106M, 106Y, 106K, and 106R.

The writing unit 39 is connected to a line memory 40 capable of storing the image data for a plurality of lines per unit line. For example, the writing unit 39 stores the image data received from the sub-control unit 33 in the line memory 40 per unit line. On this occasion, the writing unit 39 is provided with the image processing unit so that the image data to be stored in the line memory 40 can be subjected to predetermined image processing.

The writing unit 39 reads out the image data from the line memory 40 per unit line in accordance with the control by the control unit 30, and writes the image data to the photosensitive drums 109C, 109M, 109Y, 109K, and 109R by controlling the lighting of the LEDA heads 114C, 114M, 114Y, 114K, and 114R per unit pixel on the basis of the readout image data.

The image forming process unit 32 includes the aforementioned image forming units 106C, 106M, 106Y, 106K, and 106R, and performs processes such as developing and transferring of the electrostatic latent images written in the photosensitive drums 109C, 109M, 109Y, 109K, and 109R by the writing unit 39.

The image detection unit 43 (detector) is connected to the sensor unit 14, and based on the output of the sensor unit 14, the detector detects the positional deviation correction pattern formed on the carriage belt 105 with the writing unit 39 in accordance with the control of the control unit 30. The result of detecting the positional deviation correction pattern is sent to the control unit 30. Based on the result of detecting the positional deviation correction pattern, the control unit 30 controls the writing unit 39 to perform the positional deviation correction process.

The storage unit 35 stores the information representing the state of the image forming apparatus 1 at a certain time. For example, the result of detecting the positional deviation correction pattern is stored in the storage unit 35 in response to interruption caused by the control unit 30. The operation unit 34 includes an operator for receiving the user operation and a display unit for displaying the state of the image forming device 1 to a user.

The fixing unit 37 has the fixing unit 116 and a structure for controlling the fixing unit 116, and fixes the toner image on the paper by heating and pressing the paper on which the toner image has been transferred by the image forming process unit 32.

The reading unit 38 reads out the print information on the paper and converts the information into electric signals, and achieves a so-called scanner function. The electric signals which have been read out by the reading unit 38 and output are transferred to the control unit 30. This reading unit 38 and a communication unit, which is not illustrated, allow the image forming apparatus 1 to function as a multifunctional printer, which is a single body achieving the printing function, the scanning function, the copying function, and the FAX function. Note that the reading unit 38 can be omitted.

Figure 3:
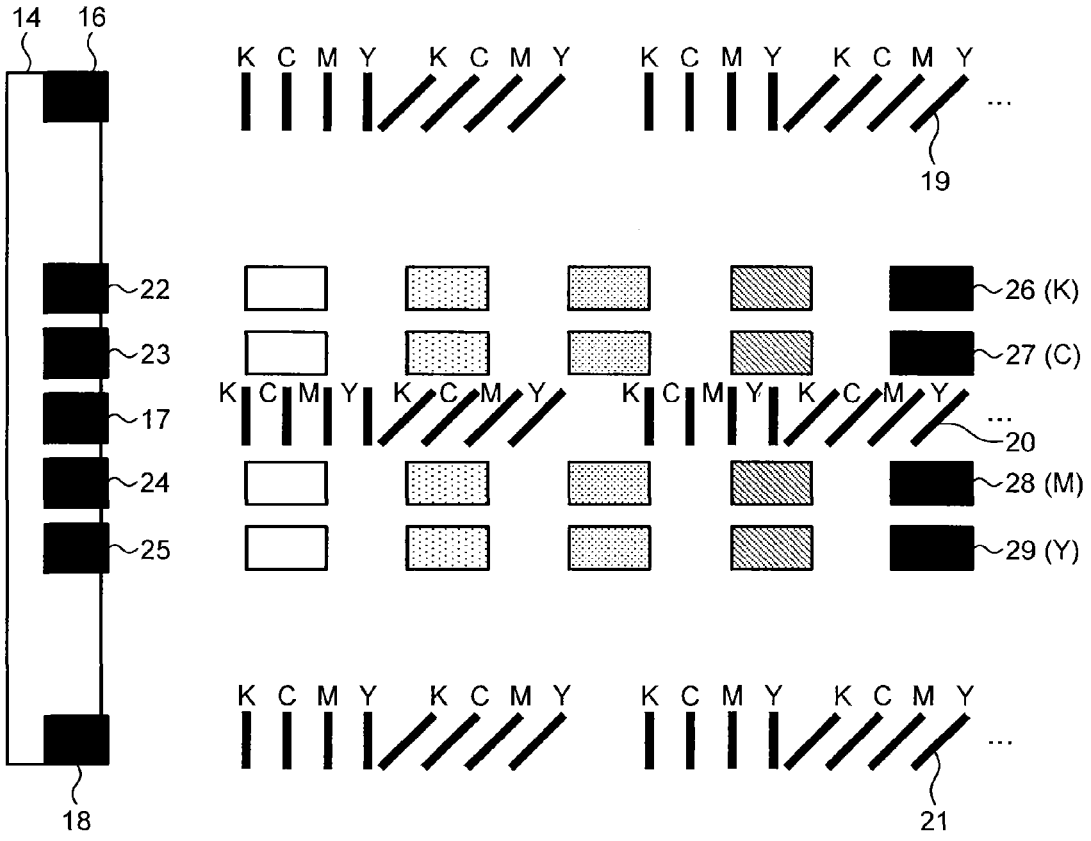
FIG. 3 is a diagram depicting an example of a pattern image of the first embodiment.

FIG. 3 depicts the detailed configuration of the sensor unit 14. As depicted in FIG. 3, in this embodiment, a process control pattern and a positioning pattern of each color are formed on the carriage belt 105, and these patterns are detected by the sensor unit 14. Note that the patterns may alternatively be formed on the intermediate transfer belt. Although the patterns in the drawing are formed based on four colors, the patterns can have another mode depending on the number of colors used.

The sensor unit 14 is provided with positioning sensors 16, 17, and 18 in the main-scanning direction, and the positioning sensors 16, 17, and 18 detect positioning patterns 19, 20, and 21, respectively. The sensor unit 14 is provided with detection sensors 22, 23, 24, and 25 for detecting the process control patterns, and the sensors 22, 23, 24, and 25 detect patterns 26(K), 27(C), 28(M), and 29(Y) arranged in parallel, respectively. The positioning patterns 19, 20, and 21 are formed by combining horizontal line patterns, which are formed by arranging lines of colors Y, K, M, and C are disposed at equal intervals in parallel to the main-scanning direction, and oblique line patterns, which are formed by arranging the color lines at equal intervals at an angle of 45° from the main-scanning direction.

Hereinafter, each of the color lines included in the positioning patterns 19, 20, and 21 is referred to as a toner mark. In other words, the positioning patterns 19, 20, and 21 are the positional deviation correction patterns each corresponding to a group of the toner marks.

The positioning patterns 19, 20, and 21 are formed in a plurality of rows in the main-scanning direction, i.e., the width direction relative to the carriage belt 105 as depicted in FIG. 3. For example, the image processing unit 41 generates the image data for forming the positioning patterns 19, 20, and 21 in accordance with the order of the control unit 30, and the image data are stored in the memory 42. Therefore, in this embodiment, the image processing unit 41 functions as the image forming unit.

The control unit 30 controls the image forming process unit 32 and the writing unit 39 on the basis of the image data stored in the memory 42 to form the electrostatic latent images of the positioning patterns 19, 20, and 21 on the photosensitive drums 109C, 109M, 109Y, and 109K. The electrostatic latent images are developed to form the toner images, and the toner images of the positioning patterns 19, 20, and 21 are transferred onto the carriage belt 105.

The number of the positioning patterns 19, 20, and 21 in each row is more than one in the sub-scanning direction, i.e., the direction where the carriage belt 105 runs. One positioning pattern 19, one positioning pattern 20, and one positioning pattern 21 are regarded as one set, and for example, eight sets of the positioning patterns 19, 20, and 21 are formed in each row.

Next, an example of a method of correcting the positional deviation which can be applied to the first embodiment is described. In this embodiment, a correction value based on which the control unit 30 performs the positional deviation correction is calculated by measuring the distance between the toner marks included in the horizontal line patterns of the positioning patterns 19, 20, and 21 and the distance between each toner mark of the horizontal line pattern and each toner mark of the oblique line pattern.

In this example, the positioning patterns 19, 20, and 21 are formed repeatedly in the sub-scanning direction at each end of the carriage belt 105 in the main-scanning direction, and two rows of the positional deviation correction patterns are formed. The distance from the head toner mark (toner mark of the color K of the horizontal line pattern) among the positioning patterns 19, 20, and 21 to the head toner mark of the positioning patterns 19, 20, and 21 disposed next to the above positioning patterns 19, 20, and 21 corresponds to the length of the positioning patterns 19, 20, and 21. The positional deviation correction pattern rows including the positioning patterns 19, 20, and 21 are sensed by the positioning sensors 16, 17, and 18, respectively, so that the control unit 30 (image quality adjustment control unit) performs the positional deviation correction process.

In the positioning patterns 19, 20, and 21, the results of sensing the toner marks included in the horizontal line patterns and the oblique line patterns by the positioning sensors 16, 17, and 18 are sampled at a certain sampling interval, and the time interval at which the toner marks in the horizontal line patterns and the oblique line patterns are sensed is measured. By multiplying the measured time interval by the known velocity of the carriage belt 105, the distance between the toner marks included in the horizontal line patterns and the oblique line patterns can be acquired. Moreover, by measuring the distance between the toner marks with the same color in the horizontal line patterns and the oblique line patterns and comparing the distance between the colors, the positional deviation amount can be obtained. As a specific calculation method, the interval of the toner marks in the horizontal line patterns and the oblique line patterns of the color K is measured with the positioning sensor 16 and the difference from the ideal interval of the toner marks in the horizontal line patterns and the oblique line patterns is calculated; then, the calculation result is assumed as A [mm]. Moreover, the interval of the toner marks in the horizontal line patterns and the oblique line patterns of the color K is measured with the positioning sensor 18 and the difference from the ideal interval of the toner marks in the horizontal line patterns and the oblique line patterns is calculated; then, the calculation result is assumed as B [mm]. Since the inclination of the oblique line is 45°, the calculation result corresponds to the positional deviation amount in the main-scanning direction at each sensor position. Accordingly, when the interval between the positioning sensor 16 and the positioning sensor 18 is D [mm], (D+B−A)/D corresponds to the proportion of the main-scanning magnification error.

Figure 4:
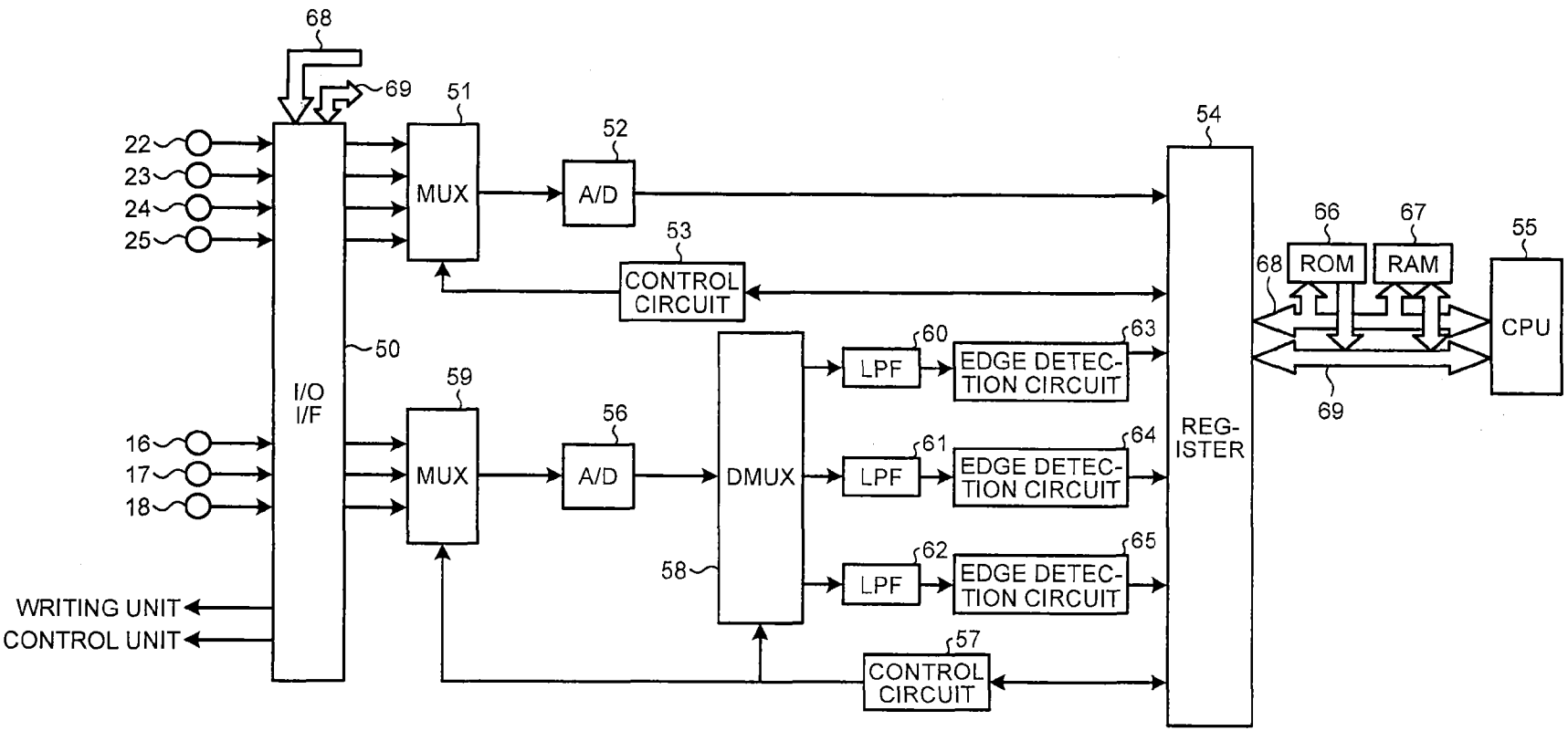
FIG. 4 is a circuit diagram depicting a hardware structure of the first embodiment.

Next, description is made of the positioning process and the process control process with reference to the block diagram of FIG. 4. The detection voltage generated when the detection sensors 22, 23, 24, and 25 for the process control pattern have detected the patterns is input to a multiplexer 51 via an I/O interface 50. A control circuit 53 controls the multiplexer 51 and an A/D converter 52 so that the selection of a sensor ch and A/D conversion operation are performed only during the pattern formation, and the obtained digital data are stored in a register 54. A CPU 55 changes the process conditions for the charging, development, the transfer, and the like depending on the obtained data.

Upon the detection of the pattern, the positioning sensors 16, 17, and 18 output the detection voltage to a multiplexer 59 via the I/O interface 50. A control circuit 57 controls the multiplexer 59 and an A/D converter 56 so that the selection of a sensor ch and A/D conversion operation are performed only during the pattern formation, and the obtained digital data are input in a demultiplexer 58. The demultiplexer 58 selects to which of LPF circuits (digital filter circuit: product-sum operation circuit) 60, 61, and 62 prepared for each sensor ch the converted digital data are output. The LPF circuits 60, 61, and 62 cut the high-frequency component, so that a pattern position can be recognized more correctly by a post-stage circuit.

Edge detection circuits 63, 64, and 65 on the downstream side of the LPF circuits 60, 61, and 62 compare the waveform of the detection voltage with a predetermined threshold voltage, and extracts the rise/drop points. The center thereof is recognized as the pattern central position and is stored in the register 54. Based on the data stored in the register 54, the CPU 55 performs change calculation and setting of the process conditions, and calculation and setting of the positioning, while storing data in a RAM 67 in accordance with the program stored in a ROM 66. The setting is transmitted to the writing unit 39 and the control unit 30 via the I/O interface 50. The I/O interface 50 is connected to the ROM 66 and the RAM 67 with an address bus 68 and a data bus 69.

The CPU 55 performs operation such as sampling start/stop and switching of sensor ch for A/D conversion with the control circuits 53 and 57 by changing the setting value of the register 54. Moreover, by changing the setting value of the register 54, the CPU 55 changes the cutoff frequency of the LPF circuits 60, 61, and 62. Further, by changing the setting value of the register 54, the CPU 55 sets the threshold voltage of the edge detection circuits 63, 64, and 65.

Therefore, the calculation process performed using the hardware for positioning control is achieved by: performing a product-sum operation with the LPF circuits 60, 61, and 62; comparing the threshold voltage and the sensor output voltage (after A/D conversion and filtering) by the edge detection circuits 63, 64, and 65; and then recognizing the center between the drop point at which the voltage drops below the threshold voltage first and the rise point at which the voltage rises above the threshold voltage first after the drop, as the pattern central position.

Figure 5A:
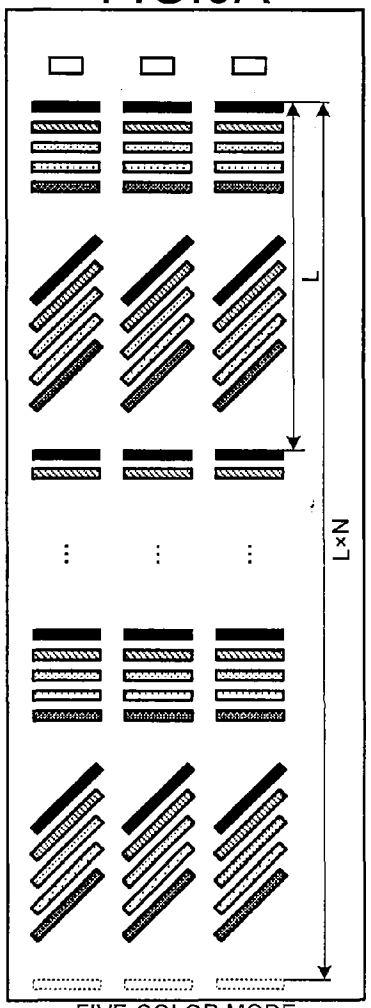
FIGS. 5A to 5D are diagrams depicting examples of a pattern image of the first embodiment.

Next, the mode of the pattern used for the positional deviation correction, etc. is described with reference to FIGS. 5A to 5D. As depicted in FIGS. 5A to 5D, the pattern for the positioning control formed in the image forming apparatus 1 is different depending on the color mode used. The color mode can be selected by a user by the operation of the operation unit 34 (reception unit) in this embodiment, and the selection result is ordered to the writing unit 39 via the control unit 30. FIG. 5A depicts the pattern image for image quality adjustment for positioning control in the case of the five-color mode and FIG. 5B to FIG. 5D each depict the pattern image for image quality adjustment for positioning control in the case of the four-color mode.

Figure 5B:
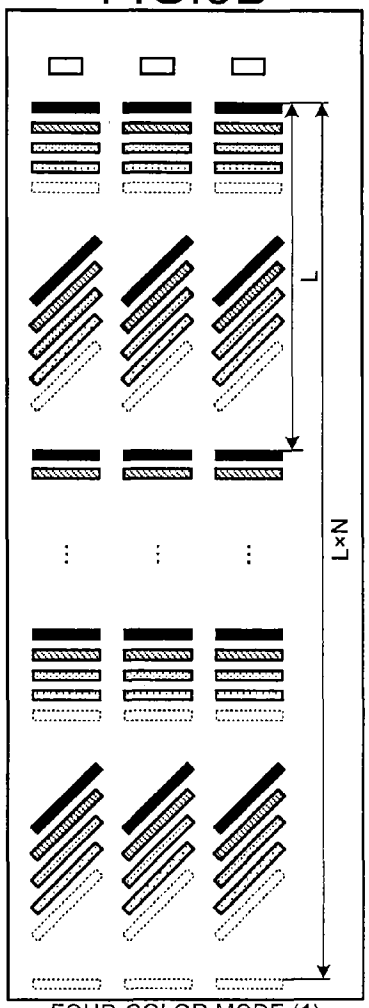
Figure 5C:
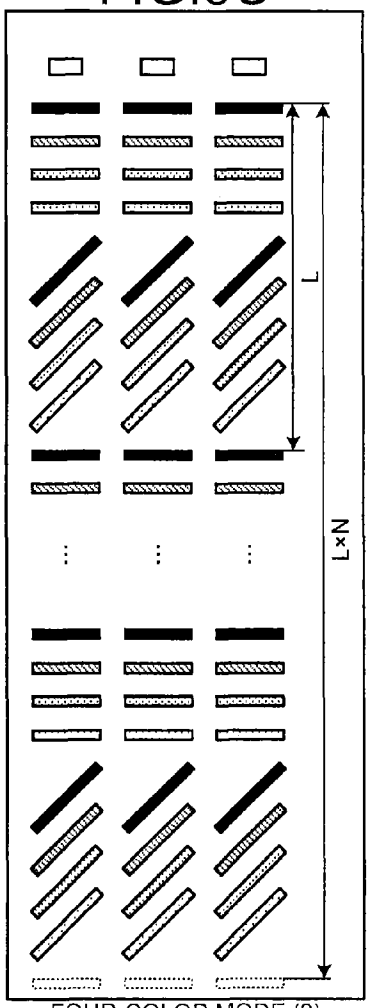
Figure 5D:
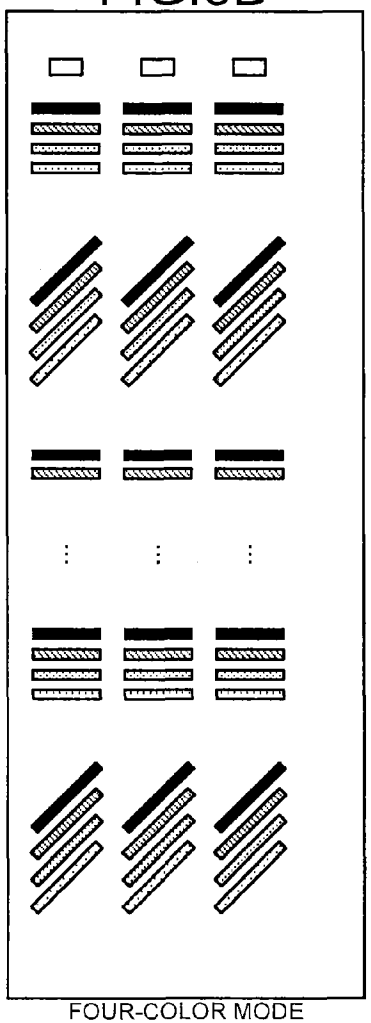

In this embodiment, the total length of the pattern image for image quality adjustment for the positioning control in the sub-scanning direction is adjusted to be the length corresponding to the drive period of the carriage belt 105. The drive period is a period for which the carriage belt 105 makes a round. When the pattern length (from the start of the writing of the patterns to the start of writing of the next set of patterns) of one set of pattern images for the image quality adjustment is set to L [mm], the image processing unit 41 (calculation unit and image forming unit) forms the patterns so that N (N is an integer) times of the length L, i.e., L×N [mm] is equal to the drive period as the total pattern length. Therefore, in this embodiment, the L×N is set by the drive period first, and the same value is applied to each L regardless of whether the color mode is the five-color mode or the four-color mode. The method of adjusting the pattern intervals may be: forming the pattern image of the four-color mode by subtracting the unnecessary color from one set of pattern images of the five-color mode as depicted in FIG. 5B; or forming the pattern image while the interval of the toner marks is increased so that the total length of one set of pattern images is equal in the five-color mode and the four-color mode as depicted in FIG. 5C. In this case, as depicted in FIG. 5D, it is possible to prevent the total pattern length from being different when the four-color pattern image is formed at the same interval of the toner mark as that in FIG. 5A.

Figure 6:
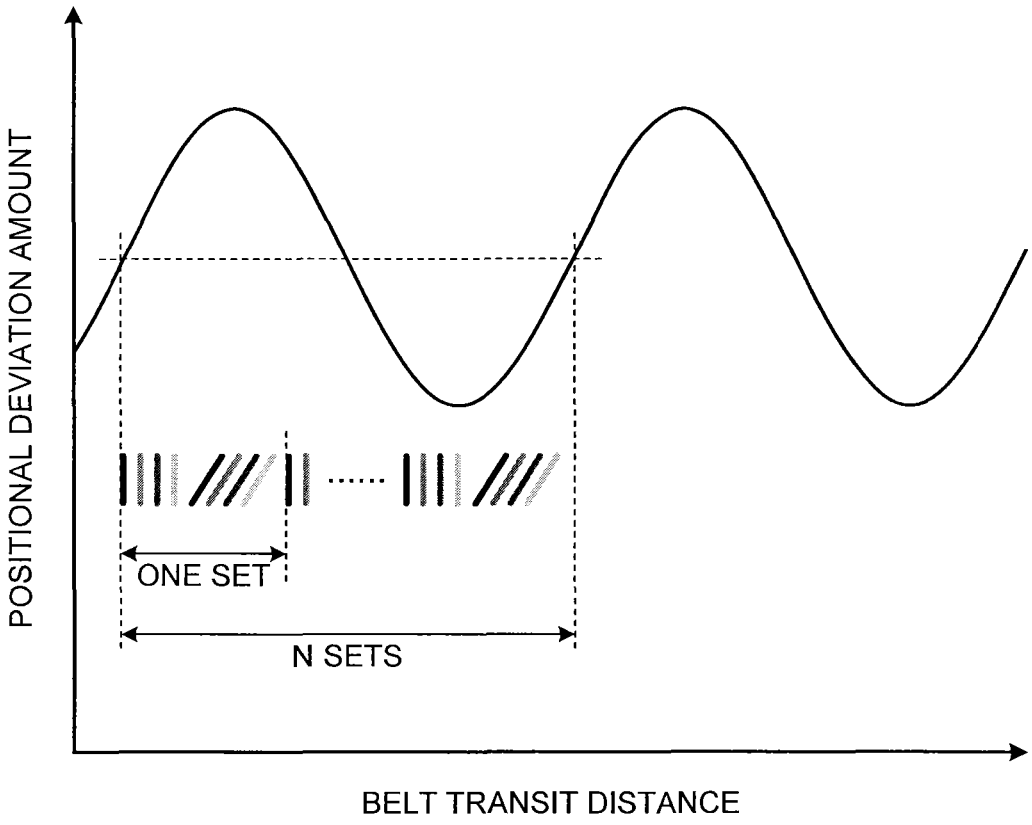
FIG. 6 is a diagram depicting the relation between the drive period and the total length of the pattern image of the first embodiment.

The relation between the drive period and the pattern image formed as above is described with reference to FIG. 6. Since the carriage belt 105 and the intermediate transfer belt for forming the pattern are driven to rotate, the rotation velocity periodically varies due to the influence of the deviation in belt thickness, the eccentricity of the rotation axis, etc. For suppressing the influence of the measurement error of the pattern position due to this periodic variation, the total length of the pattern is set to be the same as the length of one rotation of the carriage belt 105. The pattern image is formed by repeating the sets of the same patterns in the image processing unit 41, and the mean value of the positional deviation amount calculated for each set of the patterns is obtained. If the total pattern length after the repetition is equal to the drive period, the influence of the periodic variation can be reduced by taking the mean value.

In the image forming apparatus 1 of this embodiment, the total lengths of the pattern images for positioning control formed for each of the plural color modes are all matched; therefore, even though the positioning correction is performed on a certain color mode, the positional deviation due to the correction is difficult to occur because the total pattern length is the same in another color mode. Thus, the positioning correction can be performed as appropriate.

Since the total pattern length is set to match the drive period of the carriage belt 105, the influence of the measurement error of the pattern position caused by the variation in drive period can be suppressed.

Second Embodiment

The image forming apparatus 1 of a second embodiment has a feature of determining the total pattern length on the basis of the color mode with the largest number of colors. In general, as the number of colors increases, the number of toner marks included in the formed pattern increases. Therefore, if the total pattern length is determined based on the color mode with a small number of colors, the interval between the toner marks needs to be narrowed in the color mode having more colors than the mode used as the reference.

However, if the interval of the toner marks is narrowed, the overlapping between the toner marks is easily caused. Since the overlapping of the toner marks prevents the detection of the positional deviation, the maximal positional deviation amount that can be measured is reduced. In view of this, the total length of the pattern image is determined based on the color mode with the largest number of colors and set to L [mm] and the number of repetition times N is calculated; thus, the necessary and sufficient color positional deviation measurement range can be secured.

As for a specific method of calculating L and N, when the drive period of the carriage belt 105 is set to M, the minimal value, Lmin, of the length of one set of the pattern images is calculated by determining the pattern interval that can measure the necessary color positional deviation relative to the drive period. Next, by determining L and N so as to satisfy L>=Lmin and L×N=M, the pattern with the influence of the belt drive period reduced can be formed while securing the necessary color positional deviation measurement range.

Thus, by using such L and N, the pattern images of another color mode can also be generated.

Third Embodiment

Figures 7A, 7B, 7C:
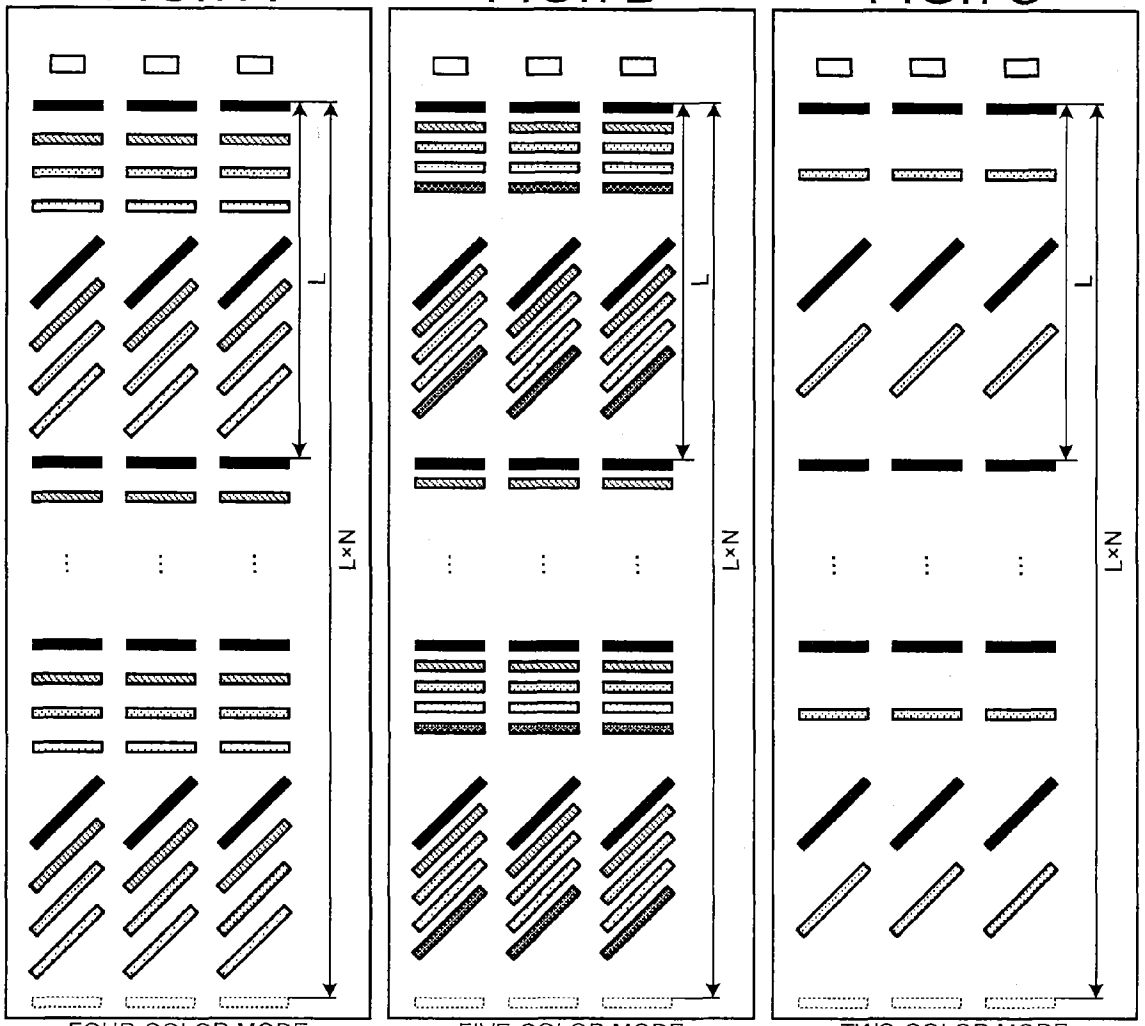
FIGS. 7A to 7C are diagrams depicting examples of a pattern image of a third embodiment.

Next, the image forming apparatus 1 of a third embodiment is described. In this embodiment, the total length of the patterns is determined based on the color mode which is assumed to be performed most frequently. FIGS. 7A to 7C depict the case in which the total length of the pattern image is set based on the four-color mode. If the proportion of the printing of the four-color mode is the largest, it is considered that the four-color mode is most frequently executed. Therefore, the image processing unit 41 determines the total length of the pattern in this mode as depicted in FIG. 7A, and in another color mode, the pattern image is formed so that the length is equal to the total length of the pattern in the four-color mode as depicted in FIG. 7B and FIG. 7C.

By optimizing the pattern shape in accordance with the color mode which is most frequently executed, the image quality of the color mode which is most frequently executed can be corrected at high accuracy, and in another color mode, by performing the color matching control without changing the total pattern length, the minimal influence of the drive period can be reduced. As for the method of selecting the color mode which is most frequently executed, for example, the number of printed sheets is stored for each color mode and the color mode where the number of the stored sheets is the largest is selected as the mode which is most frequently executed. Alternatively, for each color mode, the pattern image is prepared which is based on each color mode, and in another color mode, the pattern is formed every time so that the total pattern length is equal to that of the pattern image of the selected color mode.

The present invention provides an effect that the appropriate positional deviation correction can be performed on any of a plurality of colors modes.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image former that forms a pattern for positional deviation correction on an image carrier;

a detector that detects the pattern for positional deviation correction;

a controller that controls a positional deviation correction process in accordance with a result of detection of the detector;

a receiver that receives a color mode selected from among a plurality of color modes, each having a different number of colors used for forming the pattern; and circuitry configured to calculate a total pattern length so that a total length of the pattern for positional deviation correction in a sub-scanning direction is equal in any of the color modes, wherein the image former forms the pattern for positional deviation correction including the number of colors corresponding to the selected color mode so that the total length of the pattern for positional deviation correction is equal to the calculated total pattern length.

2. The image forming apparatus according to claim 1, wherein the image former forms the pattern for positional deviation correction so that the total length of the pattern for positional deviation correction in the sub-scanning direction is equal to N times of a distance between a same color in the pattern for positional deviation correction in the color mode with the largest number of colors, N being a positive integer.

3. The image forming apparatus according to claim 1, wherein the image former forms the pattern for positional deviation correction so that the total length of the pattern for positional deviation correction in the sub-scanning direction is equal to a length corresponding to one round drive of the image carrier.

4. The image forming apparatus according to claim 1, wherein the image former forms the pattern for positional deviation correction so that the total length of the pattern for positional deviation correction in the sub-scanning direction is equal to N times of a distance between a same color in the pattern for positional deviation correction in the color mode which is executed most frequently, N being a positive integer.

5. The image forming apparatus according to claim 1, wherein the detector includes first and second positioning sensors of the detector in a main-scanning direction which detect first and second positioning patterns, respectively, and a proportion of a main-scanning magnification error is equal to (D+B−A)/D in which A is a difference in millimeters between an ideal interval between horizontal line patterns and oblique line patterns of the first positioning pattern and a measured interval between the horizontal line patterns and the oblique line patterns of the first positioning pattern measured by the first positioning sensor, B is a difference in millimeters between an ideal interval between horizontal line patterns and oblique line patterns of the second positioning pattern and a measured interval between the horizontal line patterns and the oblique line patterns of the second positioning pattern measured by the second positioning sensor, and D is an interval in millimeters between the first and second positioning sensors.

6. The image forming apparatus according to claim 1, wherein the color modes include a five-color mode and a four-color mode.

7. The image forming apparatus according to claim 6, wherein the color modes further include a two-color mode.

8. An image forming method comprising:

forming a pattern for positional deviation correction on an image carrier;

detecting the pattern for positional deviation correction;

controlling a positional deviation correction process in accordance with a result of detection of the detecting;

receiving a color mode selected from among a plurality of color modes, each having a different number of colors used for forming the pattern; and calculating a total pattern length so that a total length of the pattern for positional deviation correction in a sub-scanning direction is equal in any of the color modes, wherein the forming the pattern includes forming the pattern for positional deviation correction including the number of colors corresponding to the selected color mode so that the total length of the pattern for positional deviation correction is equal to the calculated total pattern length.

9. An apparatus comprising:

means for forming a pattern for positional deviation correction on an image carrier;

means for detecting the pattern for positional deviation correction;

means for controlling a positional deviation correction process in accordance with a result of detection of the means for detecting;

means for receiving a color mode selected from among a plurality of color modes, each having a different number of colors used for forming the pattern; and means for calculating a total pattern length so that a total length of the pattern for positional deviation correction in a sub-scanning direction is equal in any of the color modes, wherein the means for forming form the pattern for positional deviation correction including the number of colors corresponding to the selected color mode so that the total length of the pattern for positional deviation correction is equal to the calculated total pattern length.

* * * * *